United States Patent [19]

Casey et al.

[11] 3,972,101

[45] Aug. 3, 1976

[54] TOOL FOR TRIMMING WIRES AND INSERTING THE TRIMMED WIRES INTO A CONNECTOR

[75] Inventors: Daniel Thomas Casey; William Roderick Over, both of Harrisburg, Pa.

[73] Assignee: AMP Incorporated, Harrisburg, Pa.

[22] Filed: Nov. 10, 1975

[21] Appl. No.: 630,590

[52] U.S. Cl. ..... 29/203 MW; 29/203 HT; 29/203 HC

[51] Int. Cl.[2] ..... H01R 43/04

[58] Field of Search... 29/203 MW, 203 H, 203 HT, 29/203 HC, 203 P, 628

[56] References Cited

UNITED STATES PATENTS

| | | | |
|---|---|---|---|
| 3,845,535 | 11/1974 | Over | 29/203 MW |
| 3,866,297 | 2/1975 | Aldridge et al. | 29/203 MW |

*Primary Examiner*—Carl E. Hall

*Attorney, Agent, or Firm*—F. W. Raring; R. W. Pitts; J. L. Seitchik

[57] ABSTRACT

Apparatus for simultaneously inserting a plurality of wires in the wire receiving portions of terminals in a stackable module type electrical connector has a base portion and a removable inserting tool. The base portion has a module supporting surface and wire positioning means on each side of a module positioned on the base so that wires can be positioned with their axes extending across the module and in alignment with the terminals. The removable insertion tool is then assembled to the base and actuated to cut the wires and insert them into the terminals. The wire positioning means on the base can be selectively located at different levels above the module supporting surface so that wires can be inserted into all of the modules in the connector assembly.

11 Claims, 17 Drawing Figures

62
80
84
82
101
105
113
114
106
102
115
103
104
112
108
110
136
94
86
88
70
98
116
90
100
96
92
132
122
66
124
68
134
167
156
154
118
126
72
130
77
74
142
143
76
78

172
179
173
175
113
106
114
102
103
115
112
104
80
84
82
108
10
8
116
2'
86
136
94
70
66
68
122
118
156
126
72
167
154
130
142
74
143
76
78
151
158
151
138

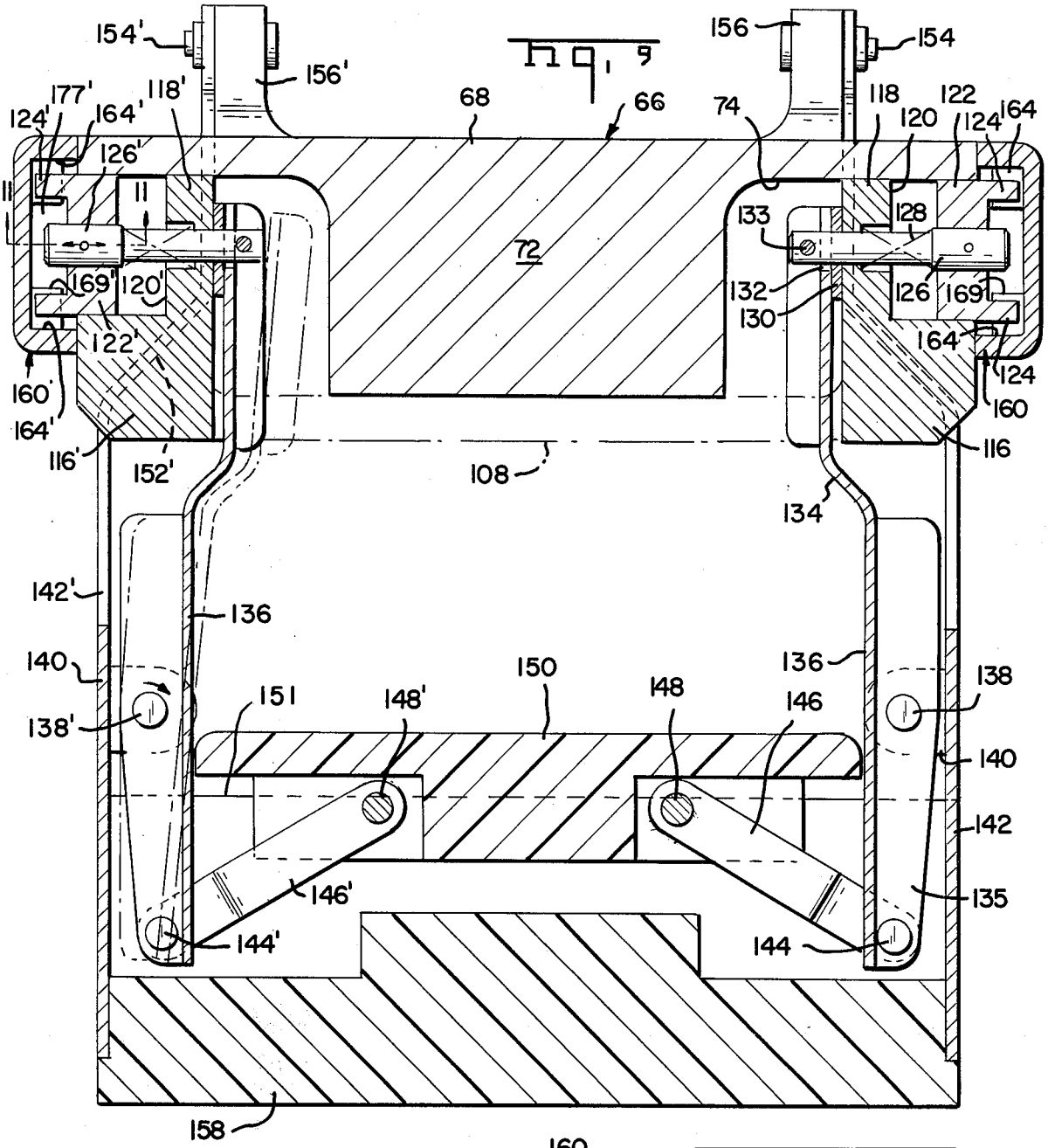
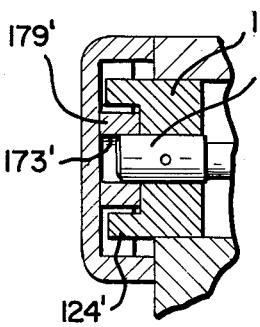
Fig. 10
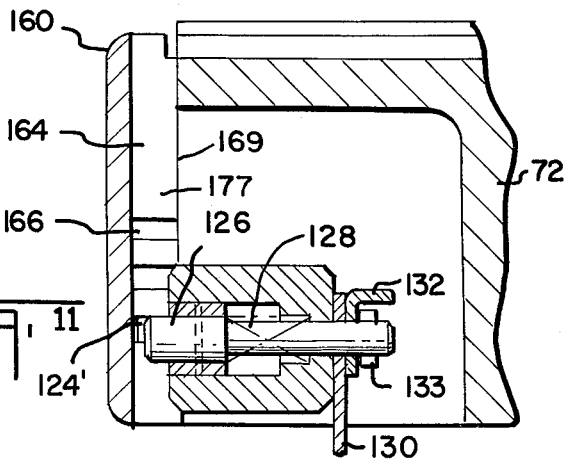
Fig. 11

TOOL FOR TRIMMING WIRES AND INSERTING THE TRIMMED WIRES INTO A CONNECTOR

BACKGROUND OF THE INVENTION

The invention relates to apparatus for trimming the ends of wires and inserting the trimmed ends into the wire receiving slots in electrical contact terminals which are contained in an electrical connector. The invention thus relates to wire insertion apparatus of the general class disclosed in U.S. Pat. Nos. 3,845,535 and 3,758,935. The instant invention is particularly intended to insert the wires into the terminals of each module of a stack of connector modules of the general type disclosed and claimed in application Ser. No. 630,589.

Co-pending application Ser. No. 630,589 discloses and claims an improved modular type multicontact electrical connector for forming semi-permanent electrical connections between the individual wires of two groups or bundles of wires. Stackable modular electrical connectors of this type are widely used in the telecommunications industry for connecting the wires in the adjacent ends of two sections of multi-conductor cable.

The modular connector shown in Application Ser. NO. 630,589 possesses many advantages in its own right, one such advantage being that the wires being connected to each other can be inserted into the terminals in a connector by means of an insertion and assembly tool in accordance with the instant invention. It should be explained that cable splicing operations are extremely time consuming and in many instances fatiguing to the technician. When the end of one cable section having, say, 3,000 pairs of wires therein is spliced to an adjacent section of cable, the technician must make 6,000 separate electrical connections between corresponding wire pairs in the ends of the two cable sections. These cable splicing operations are, moreover, carried out under relatively adverse working conditions such as the cramped quarters of a manhole, in the case of underground cables, or on an elevated platform, in the case of an arial cable.

The introduction of several new cable splicing techniques during recent years has substantially reduced the time required and the fatique accompanying cable splicing operations, however, the magnitude of the number of connections made in such operations provides a continuing spur to the development of more rapid, more convenient, and less fatiguing tooling and methods for the procedure.

The instant invention is directed to the achievement of a wire trimming and inserting tool for trimming the ends of wires and inserting the trimmed ends into each of the electrical terminals in each module of a stack of modules of a connector assembly. The invention is further directed to the achievement of an improved trimming and inserting tool for use with stacked connector modules of the type used in the telecommunication industry, a preferred form of tool in accordance with the invention including not only means for trimming and inserting the wires but in addition, improved wire positioning and locating means and means for assembling the modules of a connector assembly to each other.

It is accordingly an object of the invention to provide an improved apparatus for trimming the ends of wires and inserting the trimmed ends into the terminals of an electrical connector. A further object is to provide a tool which is adapted to be used to insert wires into each module in a stack of modules. A still further object is to provide a wire trimming and inserting tool which will be convenient and handy to use under the circumstances commonly encountered in cable splicing operations.

These and other objects of the invention are achieved in a preferred embodiment thereof which is briefly described in the foregoing abstract, which is described in detail below, and which is shown in the accompanying in which:

FIG. 3 is a view similar to FIG. 2 but showing the insertion tooling head in alignment with and spaced from the base portion.

FIG. 9 is a view taken along the lines 9—9 of FIG. 7.

FIG. 10 is a fragmentary view which illustrates the manner of attaching the tool head to the base portion.

FIG. 11 is a view along the lines 11—11 of FIG. 9.

Figure 1:
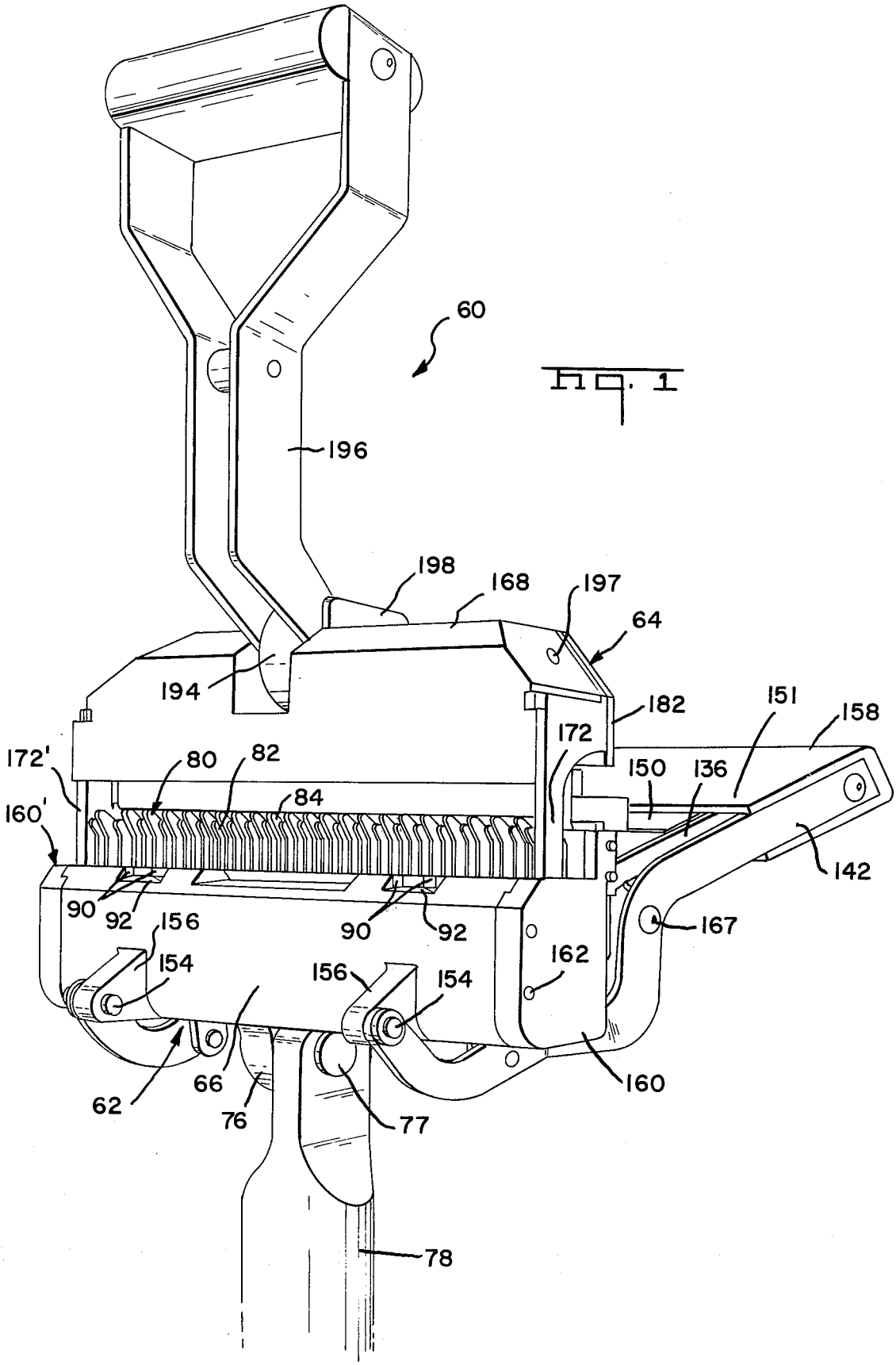
FIG. 1 is a perspective view of an apparatus in accordance with the invention.

FIGS. 14–17 show a modular electrical connector of the type fully disclosed in U.S. application Ser. No. 630,589 for which the disclosed embodiment of the instant invention is intended. The connector assembly 6 serves to connect the individual wires 2 in a bundle 4 to wires 2' in a bundle 4'. The assembly comprises a base member 8, an intermediate body member 10, and a cover 12, all of these modular members being of a suitable thermo-plastic material.

The base 8 has sidewalls 14, 16 endwalls 18, 20 and a central recess on its upper face in which a plurality of terminals 22 are mounted. The terminals are arranged in two parallel rows with the terminals in each row offset realtive to those of the other row. Endwall 16 has spaced apart notches through which the wires extend to the terminals. Each terminal 22 comprises a plate-like member having a free end 24 into which a wire receiving slot 26 extends.

Figure 17:
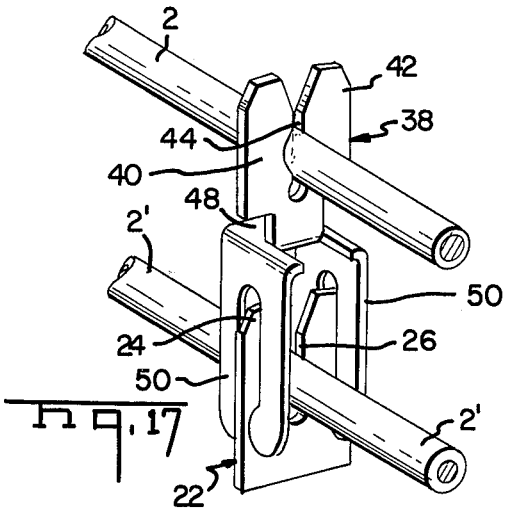
FIG. 17 shows the terminals coupled to each other and having wires connected thereto.
Figure 13:
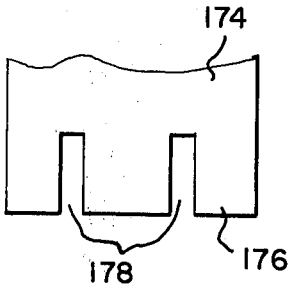
FIG. 13 is a side view, on an enlarged scale of the inserter and portions of the wire jig means.

The intermediate body member 10 has sidewalls 30, 32, endwalls 34, 36 and also has a recess on its upper face in which terminals 38 are arranged in parallel rows as previously described. Each terminal 38 (FIG. 16) has a plate-like wire receiving end 40 having a free end 42, which a wire-receiving slot 44 extends and a receptacle portion connected to the upper portion by a neck 46. The receptacle portion has a bight 48 and sidewalls 50 which have aligned slots 52 which are dimensioned to receive one of the terminals 22 as shown in FIG. 17. The terminals 38 are mounted in the body member 10 and extend through to the underside thereof so that when the body member is assembled to the base, wires connected to terminals in the base will be electrically connected to wires connected to terminals in the body as shown in FIG. 17. The body has ribs 54 on its underside for added dielectric integrity and has notches for the wires as shown. The cover member is dimensioned to fit snugly into the body and has ribs 58 on its underside 56.

Figure 2:
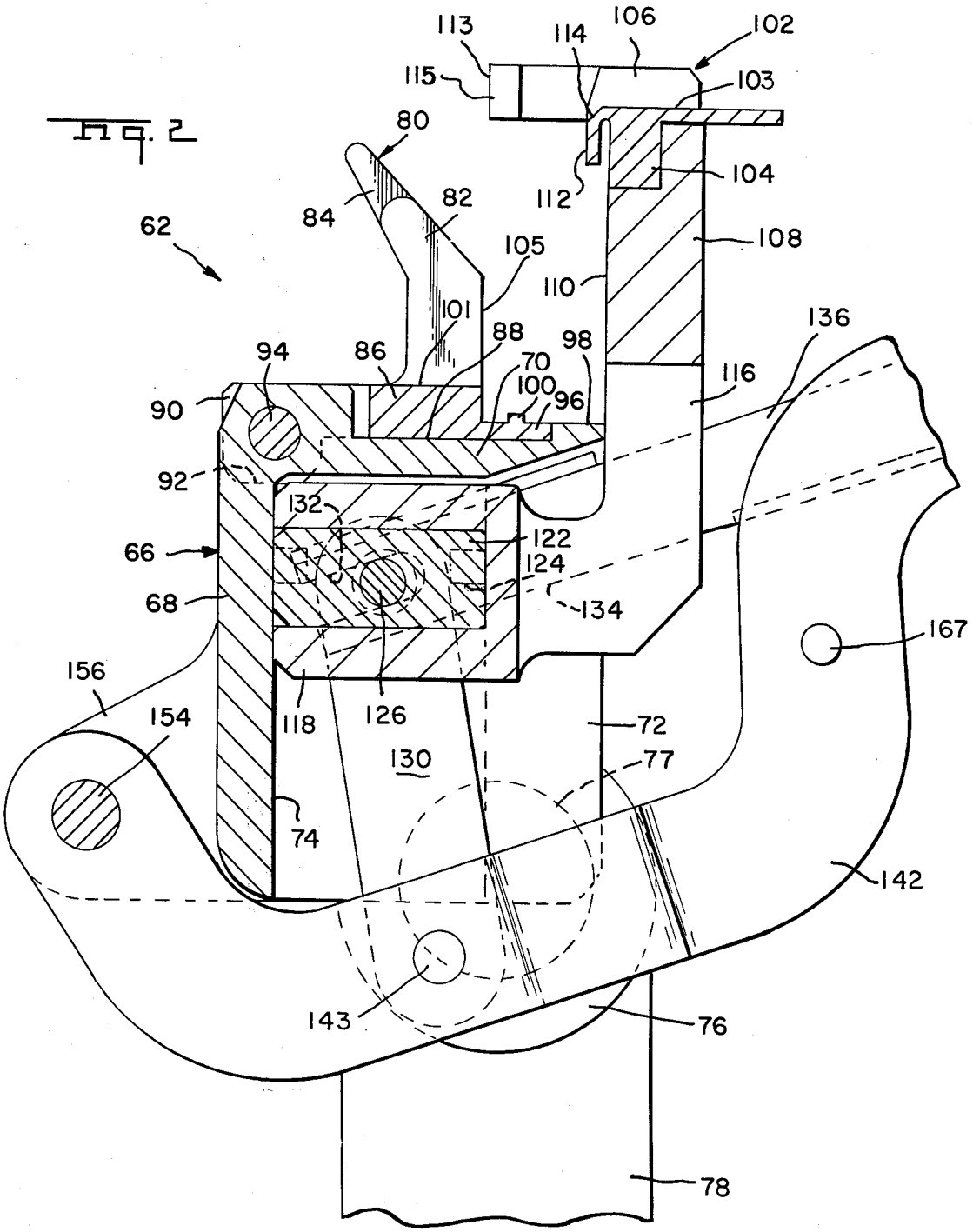
FIG. 2 is a sectional side view of the base portion of the apparatus, this view showing the positions of the parts with the adjustable wire positioning means in its uppermost position.

Referring now to FIG. 1, the apparatus 60 in accordance with the invention comprises a base portion 62 and disengageable insertion tool portion 64. The base portion has an L-shaped frame (FIG. 2) 66 composed of a depending apron 68 and a horizontally extending arm 70. A block 72 is intergral with and extends centrally from the inner surface 74 of the apron 68 and serves as a bearing surface for arms 116 as described below. Additionally, an ear 76 is provided on this block which has an adjustable pivotal connection 77 to a support column 78. The tool will ordinarily be used adjacent to the ends of cables being spliced and conventional tool mounting fixture means, of which the column 78 might be a part, can be used.

Figure 8:
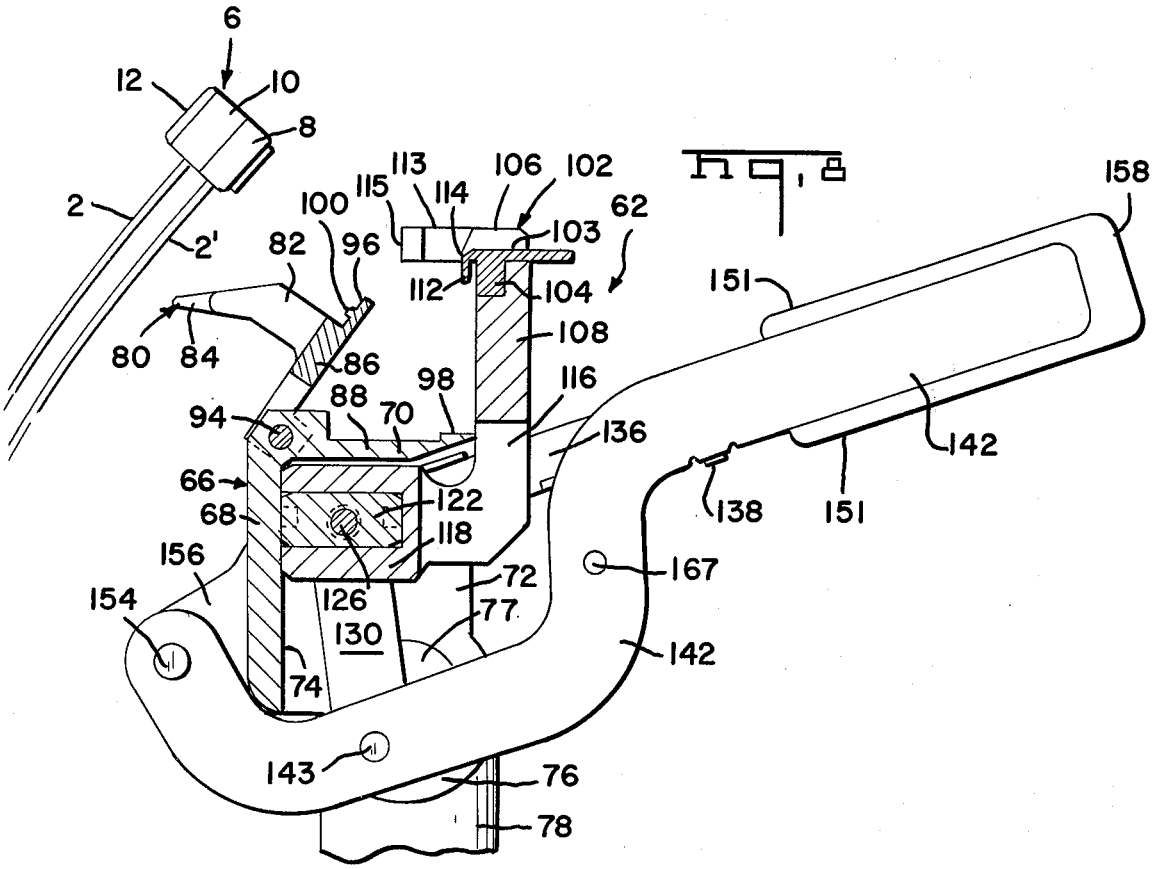

Two spaced apart combs or wire jig means 80, 102, are provided on the upper end of the base, the lefthand (as viewed in FIG. 2) jig member 80 being in the form of a plurality of alternate short and long fingers 82, 84 respectively which extend from a base block 86. The base block is disposed in a recess 88 on the upper surface of arm 70 and has spaced apart ears 90 which extend into recesses 92 in the frame. The jib member 80 is pivoted to the frame on pins 94 which extend through these recesses and through the ears 90 so that it can be swung from a closed position (FIG. 2) to an open position (FIG. 8). Torsion springs (not shown) may be provided to hold this jig member to the closed position of FIG. 2. The base portion 86 has a rightwardly extending arm in FIG. 2 which provides a surface 96 which is co-planar with a portion 98 of the surface of am 70, these surface portions 96, 98 constituting connector supporting surfaces. A boss 100 on the portion 96 of this surface is dimensioned to enter a recess in connector base section 8 accurately to align the connector base so that the teminals are in alignment with the wire supporting surfaces 101, 103 of the wire locating jigs or combs 80, 102. It will be apparent also that the width of the connector module sections 8, 10 are such that they will be received between the edges 105 of the positioning jig 80 and a surface 110 desribed below.

The righthand comb or wire jig 102 has a base portion 104 which is inset as shown in the upper end of a transverse horizontal supporting bar 108. Wire separator fins 106 extend upwardly from the base portion 104 and are located in alignment with the fingers 82, 84. The jig 102 extends leftwardly beyond the surface 110 and has a depending portion 112 which serves to assemble parts of the connector assembly to each other as will be described below. The wire supporting surfaces 103 which are between adjacent fins 106 slope downwardly and to the left adjacent to this depending portions 112 and define edges 114 which serve as shearing edges for the wires.

As mentioned above, the depending portion 112 of the jig 102 serves to assemble the parts of the connector assembly. Specifically, this depending portion pushes against one side of an intermediate body member 8 when the bar 108 and jib 102 are lowered from the position of FIG. 5 so as to press the body portion into the base 8. The pushing force of this depending portion 112 is balanced by a pair of brackets 113 secured to the ends of the wire jig inset. These brackets extend leftwardly as viewed in FIGS. 2–8 and have arms 115 on their ends. These atms extend inwardly of the inset jig member and towards each other so that they overlie the connector body member 10 shown in FIG. 5. When the support bar 108 and jig member 102 are lowered from the position of FIG. 5, the arms 115 will push downwardly on the lefthand side of the connector body member 10 and the depending portions 112 will push on the right hand side thereof so that the body member 10 will be pushed snugly into the base member 8 under the influence of balanced pushing forces.

Figure 7:
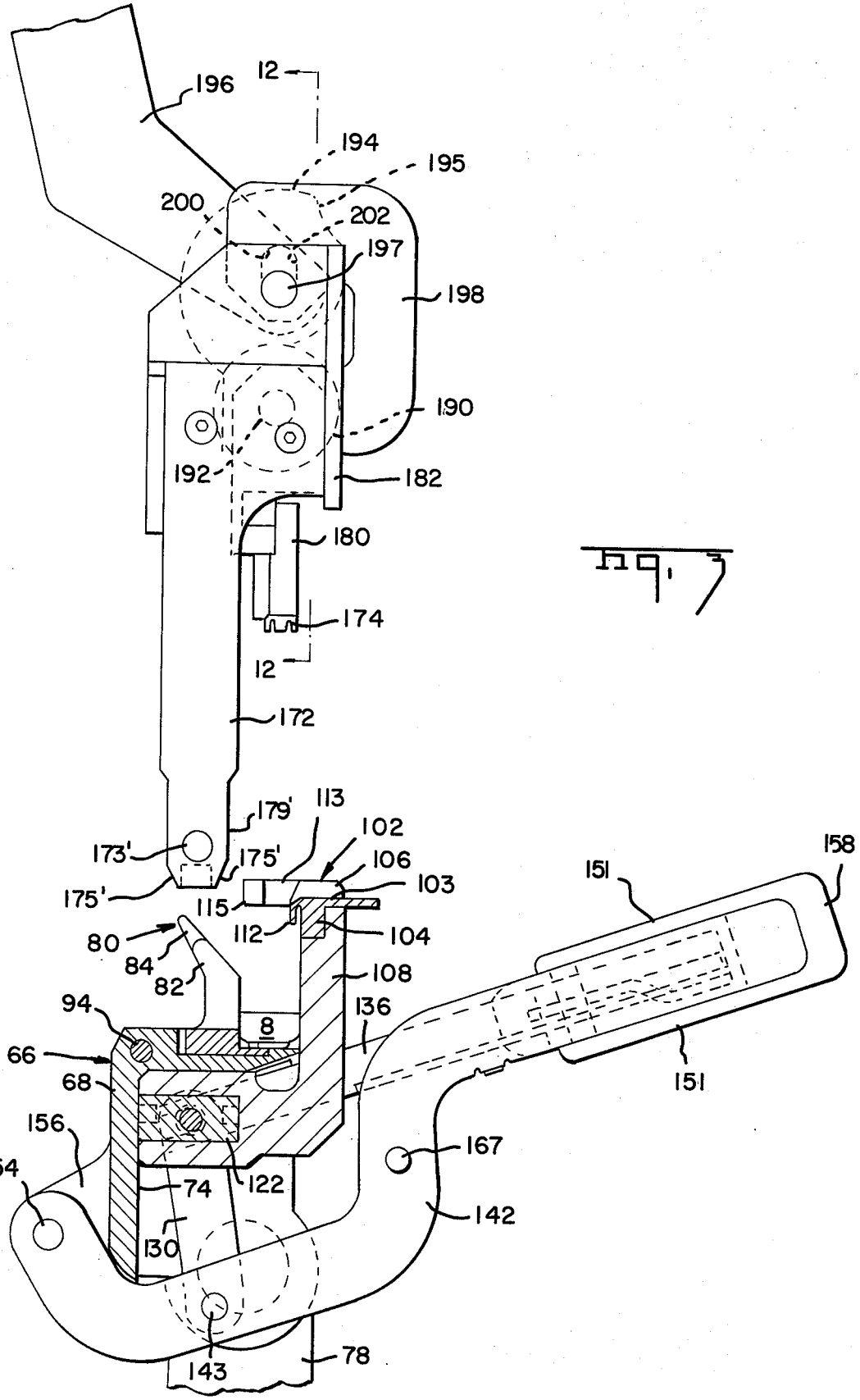
FIGs. 5–8 are views similar to FIGS. 2 and 4 but showing the positions of the parts at different stages of the process of connecting wires to a module assembly.
Figure 4:
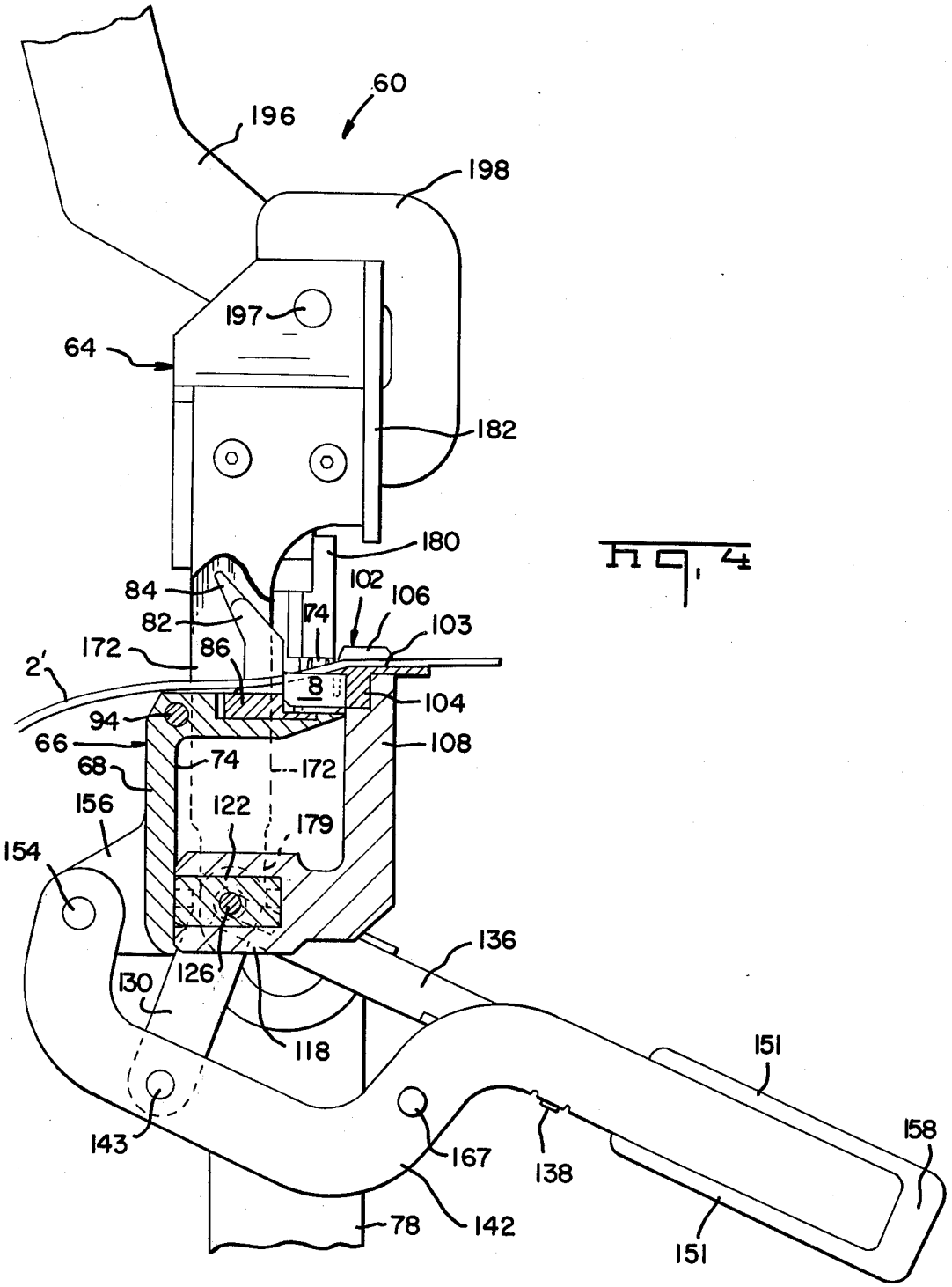
FIG. 4 is a view similar to FIG. 3 but showing the insertion tool head assembled to the base portion, this view illustrating the positions of the parts at the time of insertion of wires into a lowermost connector module.
Figure 5:
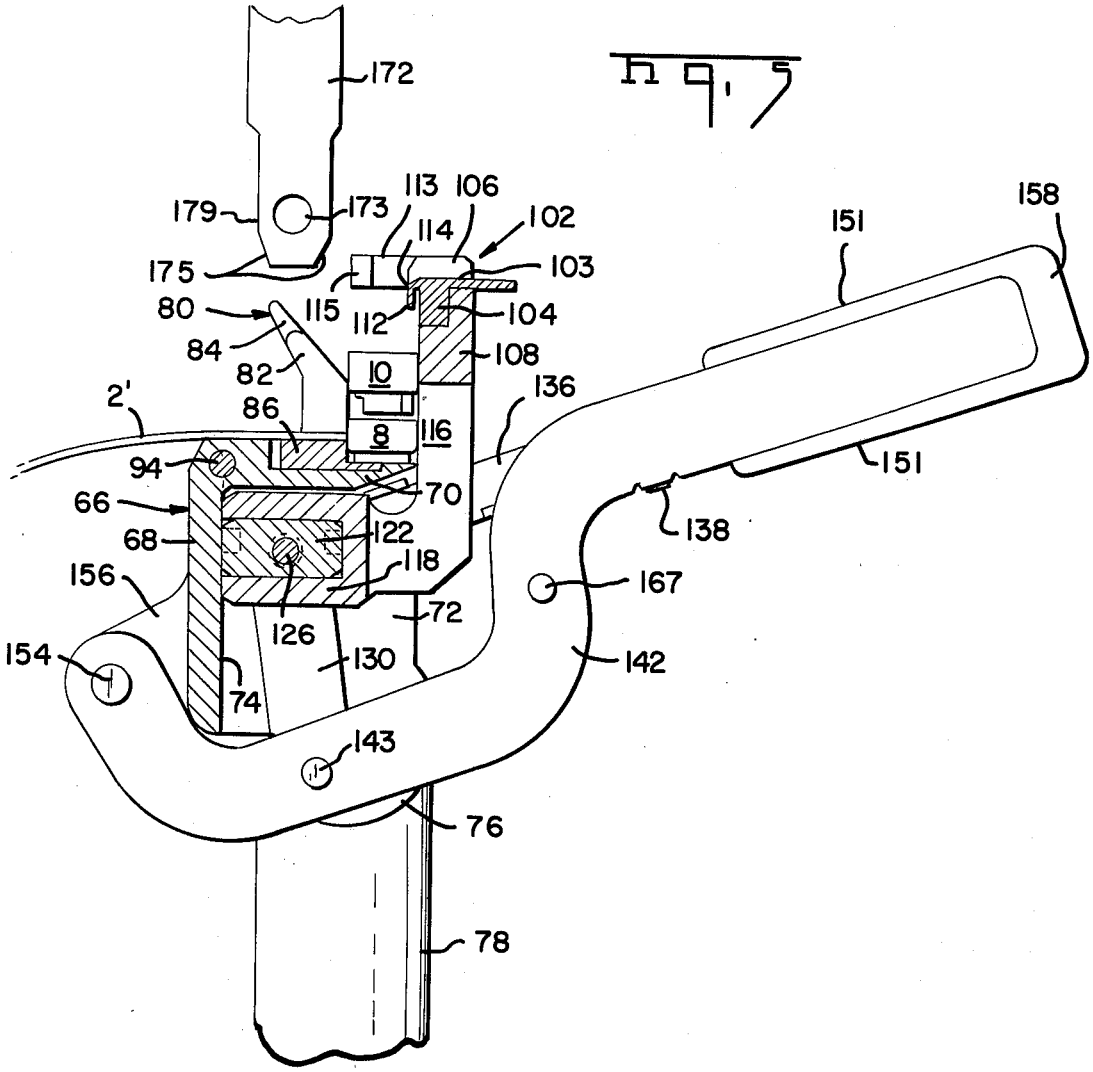

It will be apparent from an inspection of FIGS. 2–7 that the wire positioning jig 102 and the supporting member 108 can be selectively positioned relative to the supporting surface 96, 98 for the accomodation of the base member 8, the stacked intermediate body member 10, and the cover member 12 (compare FIGS. 4 and 7). This selective positioning feature will now be described.

The horizontal supporting bar 108 has depending arms 116 on its ends and these arms are coupled to the mechanisms for raising and lowering the bar shown on the upper right and left in FIG. 9. Since the mechanisms on the right and the left on FIG. 9 are similar, a description of one will suffice for both and the same reference numerals, differentiated by prime marks, will be used for corresponding structural elements.

The arm 116 has an inwardly directed end portion 118 which bears against the surface 74 and which has an outwardly facing recess 120. A latching block 122 is slidably mounted in this recess and has rightwardly extending latching projections 124 which project into the cover member 160. Latching block 122 has a centrally located pin 126, keyed or otherwise secured thereto, which extends inwardly through a counterbore in the portion 118 of the arm and beyond this arm. A spring 128 is interposed between the inner end of the counterbore and the head of the pin 126 thereby to bias the block rightwardly 120 to the position shown in FIG. 9.

Pin 126 extends through a conforming circular opening a link 130 (described below) and through a somewhat elongated slot 132 in the end of a lever 134 a cotter key 133 being provided in the end of the pin to serve as a reaction member for moving the pin inwardly when the end of the lver 134 is moved inwardly.

The lever 134 extends away from the arm 116 and has an L-shaped portion 136 which is pivoted at 138 on a pin supported on an ear 140 which extends inwardly from a handle lever 142. The outer end 135 of lever 134 is pivoted at 144 to one end of a link 146. The other end of this link is pivoted at 148 to a floating latch bar 150 which is received between spaced apart guide surfaces 151 that extend from a handle grip 158.

The handle lever 142, to which the lever 134 is pivoted at 138, has an inwardly directed portion adjacent to, and beneath, the frame member 66 and the end of this inwardly directed portion extend upwardly and are pivotally mounted at 154 to an ear 156 which extends from the external surface of the frame. The previously identified links 130 extend between the pin 126 and the lever 142 and are pivoted to the latter member at 143. It is desirable to provide a transversely extending strengthening bar between the levers 142, 142' to rigidify these members as indicated at 167.

Figure 6:
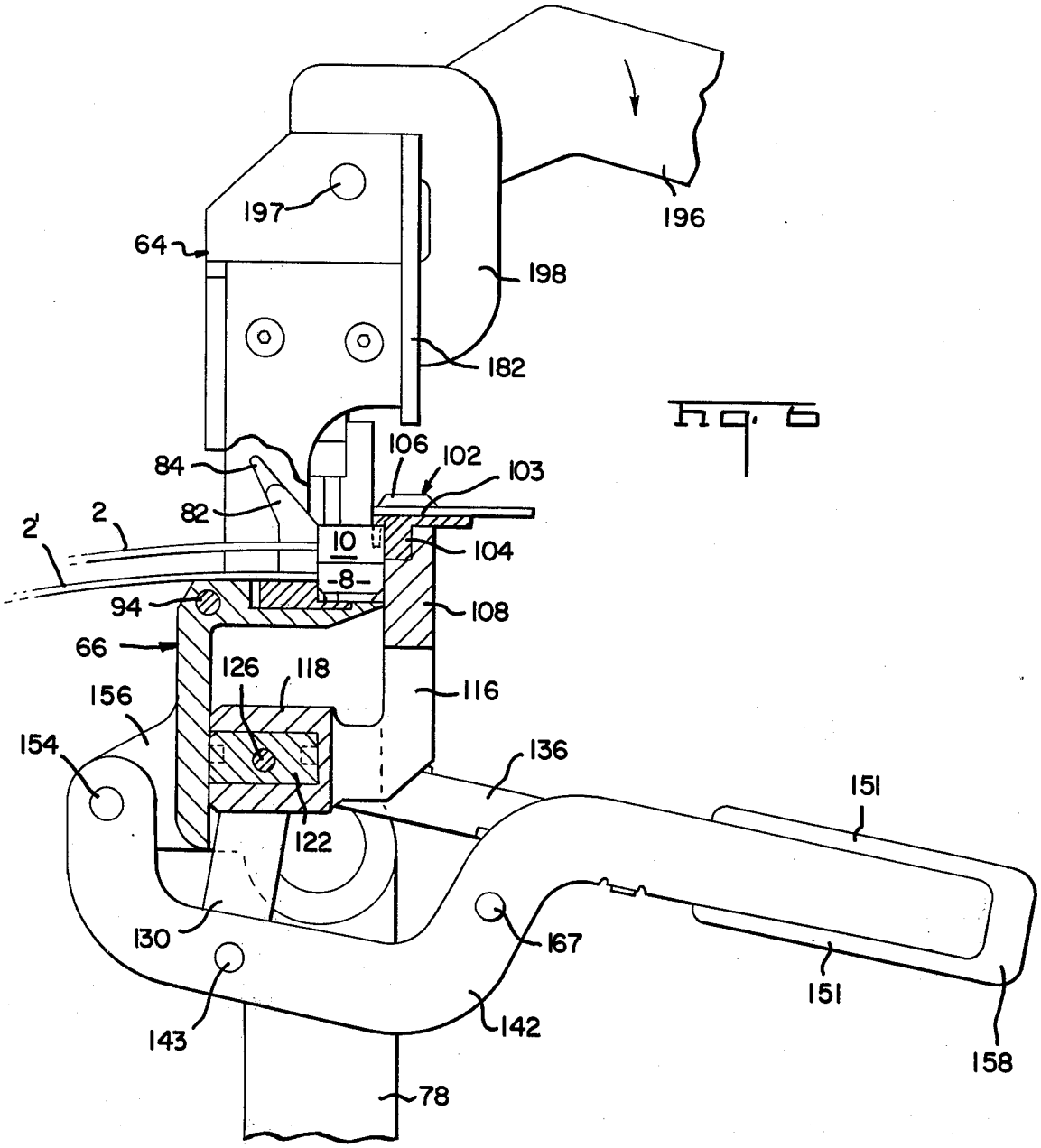
Figure 7:
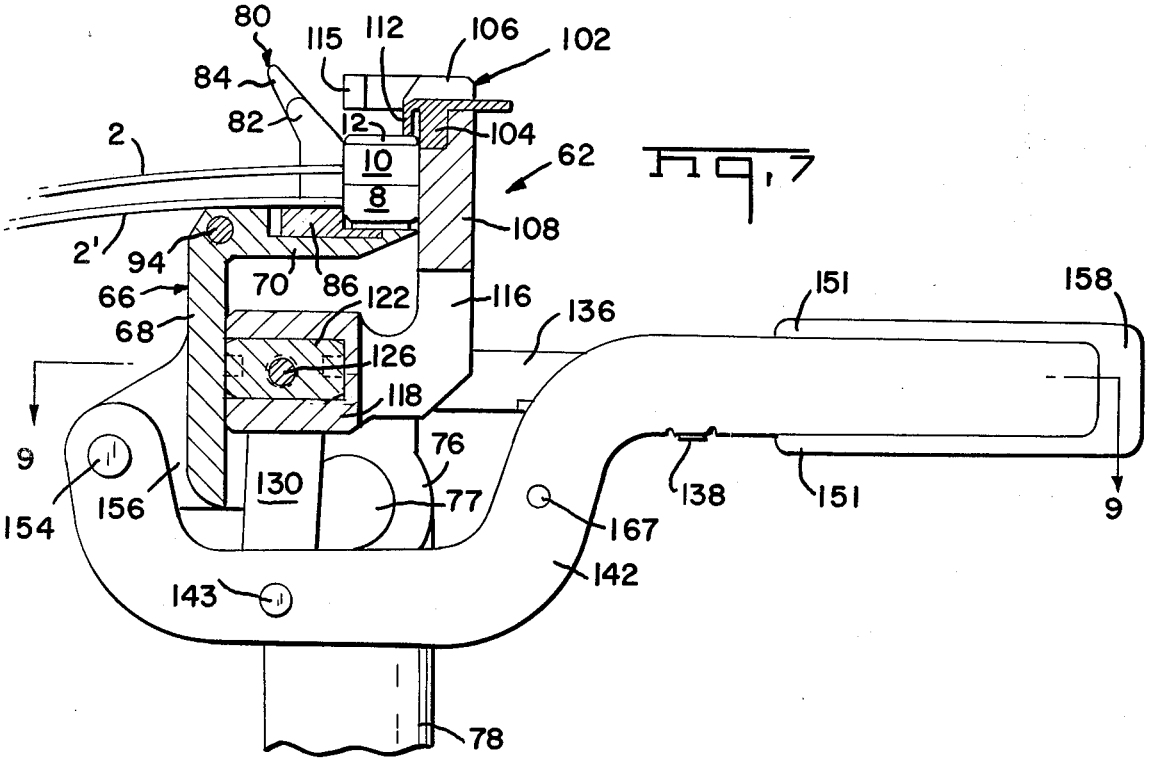

The cover plate 160 is secured against the end of the base member frame and has opposed sidwalls 164 as viewed in FIG. 9. An integral gusset block 169 is provided in the corners and spaced apart notches or recesses 166 are provided for reception of the fingers 124 in these gusset blocks. These opposed and aligned recesses 166 are located so as to position the support bar 108 and the wire jig 102 selectively in one of several positions as shown, for example, in FIG. 4 and in FIG. 7. In FIG. 4, the righthand wire jig 102 and the bar 108 are in a lowered position so that the jig 102 is properly located for positioning wires which are to be inserted into the base member 8 of the modular assembly. In FIG. 6, the wire jig is properly positioned for the operation of inserting wires into an intermdiate body portion 10 of a connector assembly. Recesses 166 are provided for other selective positions of the support bar and jig 102 as will be described below.

It will be apparent from the foregoing description that the bar member 108 and the wire jig 102 may be selectively positioned by grasping the handle grip 158 and the latch bar 150 and pulling the latch bar towards the grip 158 thereby to swing the levers 136, 136' inwardly and towards each other and to draw pins 126 126' and latch blocks 122, 122' inwardly. The fingers 124, 124' will be withdrawn from the recesses 166, 166' in which they were positioned, and the handles 142 can then be swung about their pivotal axes defined by the pins 154 to raise or lower the support bar 108. When the latch bar 150 is released, the locking blocks 122, 122' moved outwardly and the fingers 124, 124' enter the adjacent recesses 166, 166'.

The insertion tool (FIGS. 1, 3, and 12) comprises a frame means in the form of a relatively wide block 168 having a recess 170 on one face thereof. Mounting arms 172, 172' are secured to, and depend from, the ends of the block 168 and these mounting arms have openings 173 on their tapered lower ends 179, 179'. The opposed surfaces of the arms adjacent to the openings have camming surfaces 175, 175' so that when the arms are inserted into openings in the upper ends of the cover plates 160, 160' the arms will move into the passages 177, 177' defined by the opposed surfaces of the gusset blocks 169, 169'. As the arms move past the pins 126, 126' the camming surfaces 175, 175' cam the pins inwardly until they are aligned with the openings 173 173' at which time the pins return to their extended positions under the influence of the springs 128, 128' thereby to latch the insertion tool 60 to the base 62.

An inserter 174 is slidably contained between the arms 172 and is secured to the lower end of a slidable tool block 180 by suitable fasteners as shown. The inserter is a simple plate member having a lower end which is dimensioned to enter the recesses in the upwardly facing surfaces of the base 8 and the body member 10. The lower end 174 of the inserter is flat and has two slots or narrow channels 178 extending thereacross. The free end portions of the 24, 42 of the terminals enter these channels when the surface of the end 174 pushes the wires into the terminals. The channels 178 are of course, spaced apart by a distance equal to the spacing between the rows of terminals.

Figure 12:
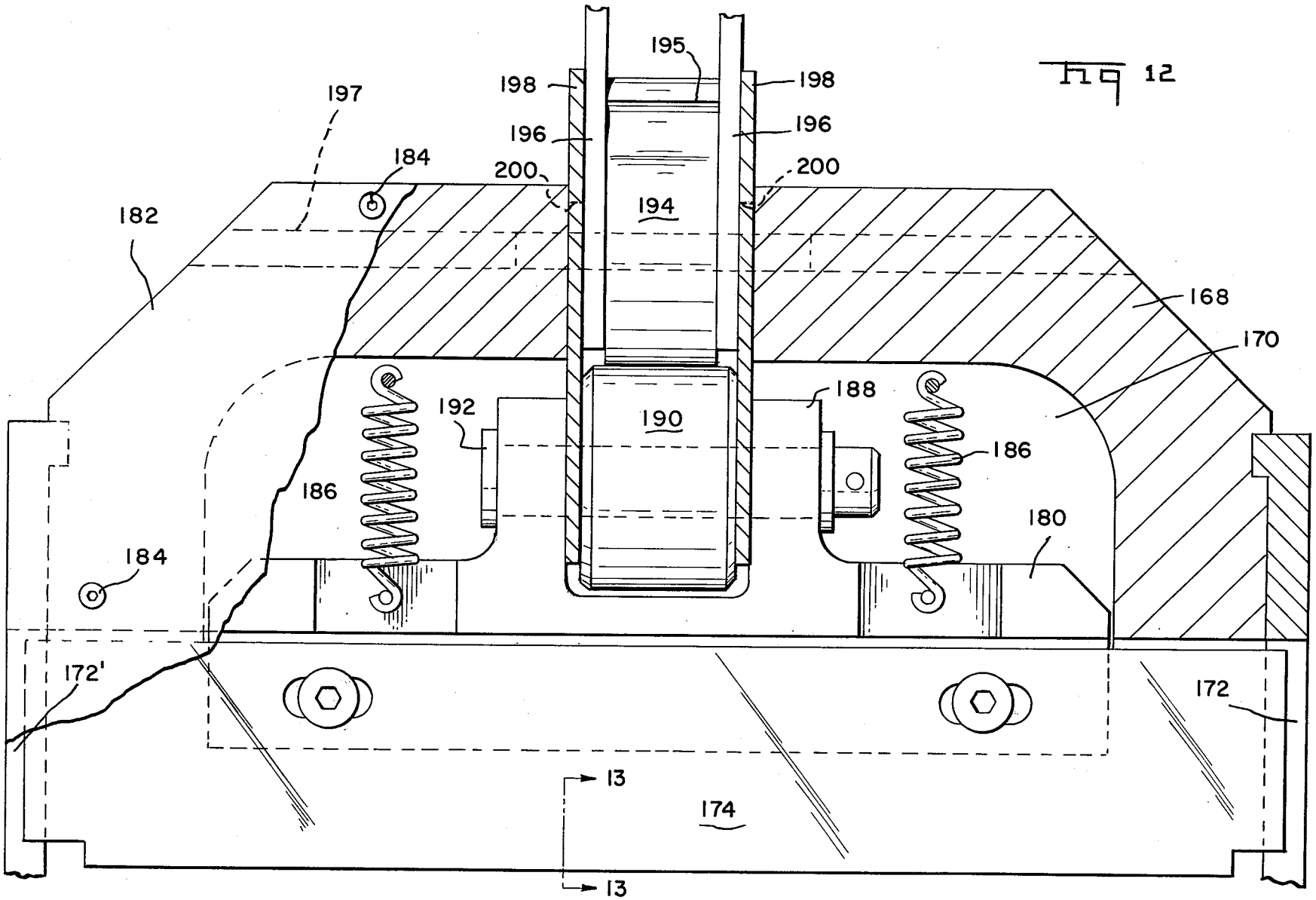
FIG. 12 is a view taken along the lines 12—12 of FIG. 3.
Figure 16:
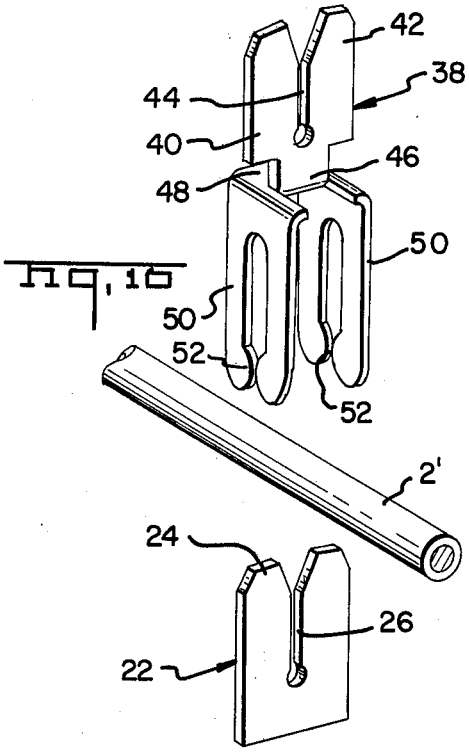
FIG. 16 is a perspective view of the two types of terminals used in the connector assembly.

The block 180 is accurately guided for reciprocating motion as viewed in FIG. 12 by the opposed sides of the recess 170 and the internal surface of a cover plate 182 which is secured to the face of the block 168 by fasteners 184. The tool block 180 has a central boss 188 through which a pin 192 extends and a roller 190 is mounted on this pin in a central opening in the boss. The roller is engaged by a cam 194 which is secured to spaced apart handle levers 196 and which is rotatably mounted on a shaft 197 in the frame block 168. It will be apparent from FIG. 3 that clockwise rotation of the handles 196 and the cam from the position shown will drive the roller 190 and the block 180 downwardly. The lowermost position to which the tooling is moved is precisely defined by a stop 195 on the cam.

The block 180 is biased upwardly in FIG. 12 by springs 186 which extend from recesses in the block to fixed pins as shown. However, when the inserter is lowered and the wires are pushed into the terminals, the inserter tends to be held in its lower position by the insulation on the wires which is extruded partially into the channels 178. It is devisable to provide a means of breaking the inserter loose when the block 180 is raised such as links 198. These links elongated slots 200 through which the shaft 197 extends. The pin 192 extends through conforming circular openings in the lower ends of the links which are on each side of the roller 190. The handle 196, 196' have integral struck out ears which, during the final stages of counterclockwise movement of the handles; from the position of FIG. 6 to the position of FIG. 4, engage edge portions of the links and raise them. The mechanical advantages of the handles is then utilized to break the tool block 174 loose and the springs 180 will then raise the block to its normal position.

In use, the tool base 62 is first properly positioned on support 78 with respect to the cable ends, and a base member 8 of the connector assembly is then positioned on the surfaces 96, 98. The handles 142, 142' and the latching mechanism are manipulated to lower the support bar 108 and the wire jig 102 until they are in the position of FIG. 4. The insertion tool 64 is not assembled to the base at this time. The wires 2' of the bundles 4' are then located in the wire jigs 80, 102 with their axes extending transversely of the terminals, one wire being positioned between each pair of adjacent fingers and barriers on the jigs as shown in FIG. 4. The long fingers 84 of the jig 80 serve as wire pair splitters during this wire positioning step.

The insertion tool 64 is then assembled to the base and the handle is swung through a clockwise arc to lower the inserter 174. When this inserter moves past the cutting edges 114 of the wire jig 102, the edge of the inserter cooperates with edges 114 to sever the wires. The trimmed wires are then pushed into the wire-receiving slots 26, 44 of the terminals by the end 176 of the inserter and the upper portions of the terminals are received in the channels 178. Thereafter the handle 196 is swung in the opposite direction to raise the inserter 174 and the insertion tool 64 is removed from the base 62. The handle and latch mechanism 142 are then manipulated to raise the support bar 108 and the jig 102 and an intermediate body member 10 is positioned on top of the base member 8, (see FIG. 5).

The handle and latch mechanism are then lowered and when the inwardly directed arms 115 on the ends of the brackets 113 and the depending portions 112 of the jig inset 102 engage the intermediate body member during downward movement of the bar 108, these arms 115 and portions 112 push the intermediate body member into assembled relationship with the base member. When the bar 108 is latched in the appropriate position as shown in FIG. 6, the wires 2 of the bundle 4 are positioned in the wire jigs 80, 102, the insertion tool is again assembled to the base and the tool is actuated to trim the wires and insert them into the intermediate body member. Thereafter, the bar 108 is raised, a cover member 12 is placed on the intermediate body member and the handle and latch mechanism 142 are swung through a clockwise arc to press the cover member into assembled relationship with the intermediate body. The wires 2 will then have been electrically connected to the wires 2' in the assembled connector 6 and it can be removed from the tooling by removing the inserting tool from the base, raising the bar member 108 to its uppermost position, swinging the positioning jig 80 counterclockwise as shown in FIG. 8, and lifting assembled connector from the tool.

Figure 15:
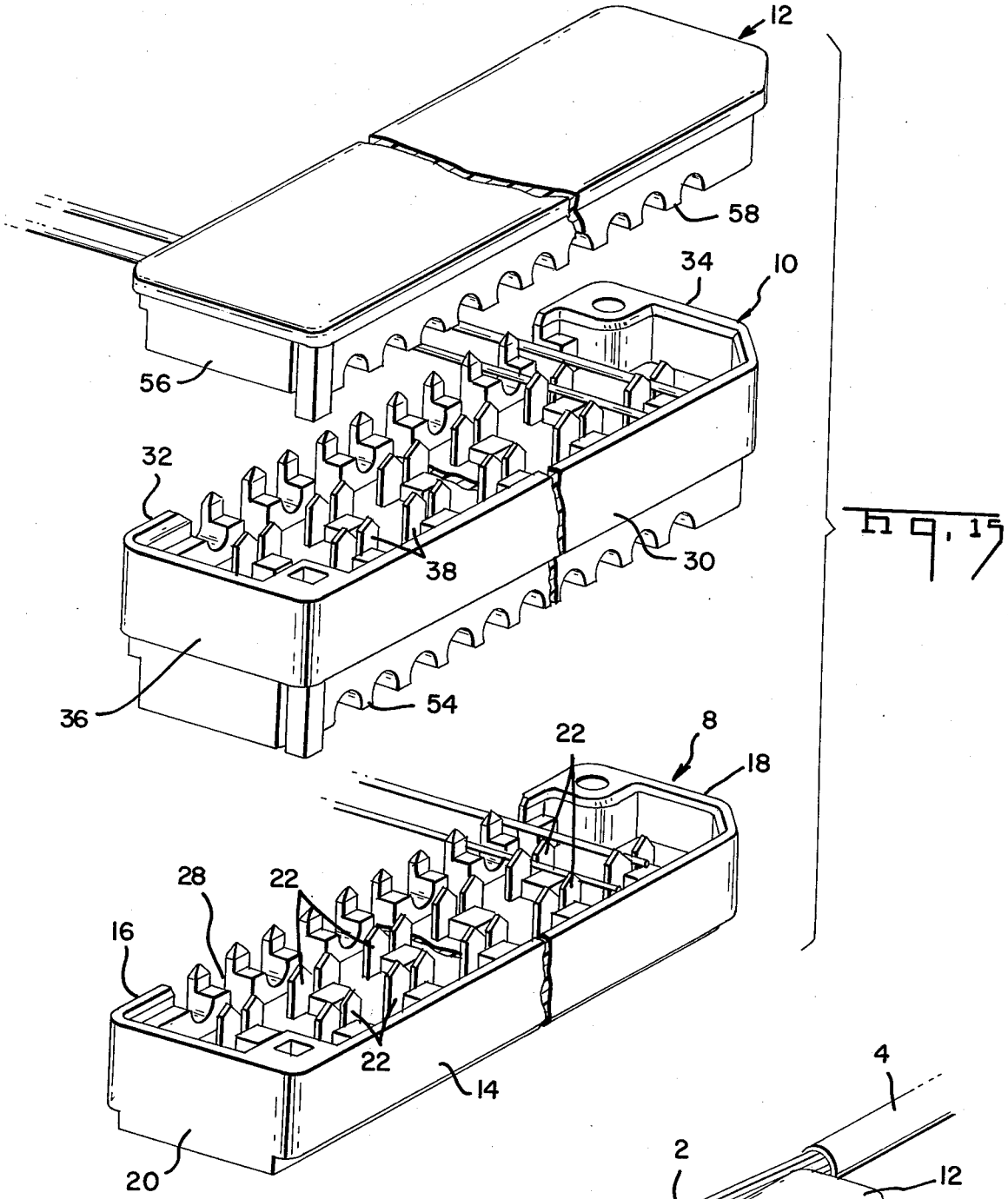
FIG. 15 is an exploded view of the connector assembly.
Figure 14:
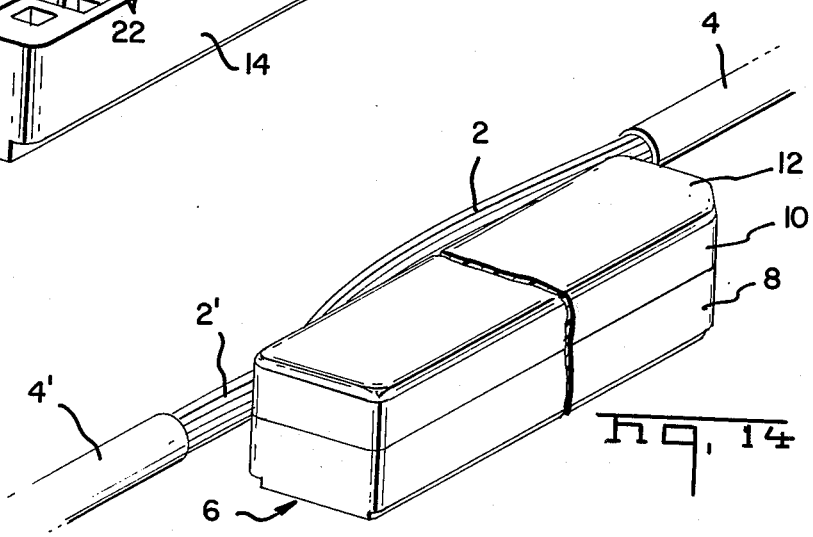
FIG. 14 is a perspective view of a modular connector assembly of the type for which the disclosed embodiment is intended.

A salient feature of an insert tool in accordance with the invention is that it can be used to insert wires into all of the stacked modules used in a modular multi-conductor connector of the type shown in FIG. 15. Several wire receiving modules can be stacked on top of each other; if it is desired to make a tap connection, a second intermediate body 10 would be used to receive the wires of the tap cable. The end plates 160 are provided with recesses 166 for locating the jig 102 at the level of each module.

Another salient feature of the invention is that the mechanism for raising and lowering the member 108 is employed to assemble the parts 8, 10, 12 of the module assembly to each other. The operator is not required to perform this operation and need not use a separate tool to carry it out. The instant apparatus thus serves as an assembly tool for assembling the module, as a wire insertion tool at any of the levels of the module and finally as a wire locating means for positioning the wires with respect to the terminals prior to insertion.

Complete insertion of the wires into the terminals is ensured by several noteworthy features of the insertion tool 64, the base 62, and the manner of mounting the insertion tool on the base. To illustrate, the module part is precisely located on the base when the depending portion 112 of the jig 102 is against the recessed surface of the module as shown in FIG. 4. The vertical positioning of the depending portion 112 of the jig 102 is, in turn, determined by the positioning block 122, 122' and pins 126, 126' as explained above. After wires have been positioned in the wire jigs 80, 102 and the insertion tool is mounted on the base, the insertion tool will be at the correct elevation for the module part in the tool because of the fact that the elevation of the insertion tool is determined by the pins 126, 126' which enter the holes 173, 173' in the arms 172, 172', (see FIG. 10) and the pins are mounted in the blocks 122, 122'. Finally, the downward stroke of the inserter 180 is, as previously mentioned, precisely controlled by the stop 195 on the cam 194. All of the parts of the assembly are precisely located with respect to each other and with respect to the connector module and the stroke of the inserter 174 is precisely controlled with respect to these and with respect to the terminals in the module.

What is claimed is:

1. Apparatus for inserting a plurality of wires into the wire-receiving portions of a plurality of electrical contact terminals, said terminals being mounted on a planar surface of a stackable electrical connector module, each of said terminals having a platelike portion extending from said planar surface and having a free end, each of said terminals having a wire receiving slot extending inwardly from said free end, said apparatus comprising:

frame means, said frame means having connector supporting surface portions thereon for supporting said connector module, wire jig means for locating said wires with their axes extending across a connector module which is supported on said supporting surface portions and with said axes in alignment with said wire receiving slots, inserting means for moving said wires laterally of their axes and into said wire-receiving slots in said terminals, selective positioning means for said wire jig means for selectively positioning said wire jig means in first and second positions, said wire jig means being effective in said first position to locate said wires in alignment with said slots in said terminals in a first connector module supported directly on said connector supporting surface portions, said wire jig means being effective in said second position to locate said wires in alignment with said slots in said terminals in a second connector module supported on said first connector module.

2. Apparatus as set forth in claim 1, said apparatus comprising a tool base, said inserting means comprising a wire inserting tool means removably mounted on said tool base.

3. Apparatus as set forth in claim 1, said wire jig means comprising first and second wire jig members, said jig members being on opposite sides of connector supporting surface portions.

4. Apparatus as set forth in claim 1, said wire jig means comprising a selectively positionable wire jig member disposed beside said connector supporting surface portions, said selective positioning means comprising means for moving said selectively positionable jig member towards and away from said connector supporting surface portions and latching said jig member in said first and second positions.

5. Apparatus as set forth in claim 4 including connector module assembling and clamping means for clamping said first connector module on said supporting surface portions, for pushing said second connector module towards, and into assembled relationship with, said first connector module, and for clamping said first and second connector modules against said supporting surface portions.

6. Apparatus as set forth in claim 5, said assembling and clamping means being on said selectively positionable wire jig member.

7. Apparatus as set forth in claim 6, said apparatus having a tool base, said selectively positionable wire jig member being on said tool base, said inserting means comprising a wire inserting tool means mounted on said tool base and being selectively positionable in first and second positions with respect to said tool base, said first and second positions of said tool base corresponding to said first and second positions of said wire jig means.

8. Apparatus as set forth in claim 7, said selective positioning means for said wire jig means being effective selectively to position said inserting tool means.

9. Apparatus for inserting a plurality of wires into the wire-receiving portions of a plurality of electrical contact terminals, said terminals being mounted on a planar surface of a stackable electrical connector module, each of said terminals having a wire-receiving portion extending from said planar surface and having a free end, each of said terminals having a wire receiving slot extending inwardly from said free end, said apparatus comprising:

a tool base, said base having connector supporting surface portions thereon for supporting said connector module, wire jig means on said tool base for locating said wires with their axes extending across a connector module supported on said supporting surface portions and with said axes in alignment with said wire receiving slots, said wire jig means comprising a wire jig member disposed beside said connector supporting surface portions, selective positioning means for selectively positioning said wire jig member in any one of several selective positions, said selective positions being at predetermined distances from said supporting surface portions in a direction extending normally of said supporting surfaces whereby said jig member can be positioned beside a first connector module supported directly on said supporting surface portions and can be positioned beside modules stacked on top of said first connector module.

10. Apparatus as set forth in claim 9 including insertion tool means for inserting said wires into a module on said base.

11. Apparatus as set forth in claim 10, said insertion tool means being removably mountable on said tool base.

* * * * *